US009561646B2

(12) United States Patent
Dipert et al.

(10) Patent No.: US 9,561,646 B2
(45) Date of Patent: Feb. 7, 2017

(54) HIGH SPEED ADAPTIVE THERMAL PRINTHEAD INTERFACE

(71) Applicant: ZIH CORP., Lincolnshire, IL (US)

(72) Inventors: Dwight D. Dipert, Barrington, IL (US); Ashok K. Charles, Lombard, IL (US); Daniel Donato, Johnsburg, IL (US); Robert Ehrhardt, Palatine, IL (US); David Schmitt, Bolingbrook, IL (US)

(73) Assignee: ZIH Corp., Lincolnshire, IL (US)

( * ) Notice: Subject to any disclaimer, the term of this patent is extended or adjusted under 35 U.S.C. 154(b) by 0 days.

(21) Appl. No.: 14/670,969

(22) Filed: Mar. 27, 2015

(65) Prior Publication Data

US 2016/0368265 A1 Dec. 22, 2016

(51) Int. Cl.

| | |
|---|---|
| ***B41J 29/38*** | (2006.01) |
| ***B41J 2/045*** | (2006.01) |
| ***B41J 2/32*** | (2006.01) |
| ***B41J 2/14*** | (2006.01) |
| ***B41J 2/355*** | (2006.01) |

(52) U.S. Cl.

CPC ..... *B41J 2/04541* (2013.01); *B41J 2/04551* (2013.01); *B41J 2/14072* (2013.01); *B41J 2/32* (2013.01); *B41J 2/355* (2013.01)

(58) Field of Classification Search

CPC ..... B41J 3/543; B41J 2/17543; B41J 3/54

See application file for complete search history.

(56) References Cited

U.S. PATENT DOCUMENTS

| | | | | |
|---|---|---|---|---|
| 4,500,933 | A | 2/1985 | Chan | |
| 4,930,915 | A * | 6/1990 | Kikuchi | B41J 2/505 347/211 |
| 5,534,801 | A | 7/1996 | Wu et al. | |
| 5,736,997 | A * | 4/1998 | Bolash | B41J 2/0451 347/19 |

(Continued)

FOREIGN PATENT DOCUMENTS

| | | |
|---|---|---|
| CN | 1283818 A | 2/2001 |
| EP | 0751003 A1 | 1/1997 |

(Continued)

OTHER PUBLICATIONS

International Search Report and Written Opinion from corresponding International Patent Application No. PCT/US2016/021487 mailed Jun. 22, 2016.

(Continued)

*Primary Examiner* — Julian Huffman

(57) ABSTRACT

Systems, methods, and apparatuses are disclosed for providing a high speed adaptive thermal printhead interface. In one embodiment, an apparatus is provided comprising at least one processor; and at least one memory including computer program instructions, the computer program instructions being configured to, when executed by the at least one processor, cause the apparatus at least to determine identifier information for a connected printhead; retrieve printhead interface configuration data for a configurable printhead interface based at least in part on the identifier information; configure printhead interface circuitry in accordance with the printhead interface configuration data; and enable communication with the printhead through the configurable printhead interface.

35 Claims, 3 Drawing Sheets

(56) References Cited

U.S. PATENT DOCUMENTS

| | | | | |
|---|---|---|---|---|
| 5,809,329 | A | 9/1998 | Lichtman et al. | |
| 6,012,143 | A | 1/2000 | Tanaka | |
| 6,470,284 | B1 | 10/2002 | Oh et al. | |
| 6,572,384 | B1 | 6/2003 | Marchevsky | |
| 6,658,497 | B1 | 12/2003 | Kawasaki et al. | |
| 6,671,748 | B1 | 12/2003 | Cole et al. | |
| 6,895,447 | B2 | 5/2005 | Brewer et al. | |
| 7,080,164 | B2 | 7/2006 | Jacobs et al. | |
| 7,433,983 | B2 | 10/2008 | Lu | |
| 7,738,137 | B2 * | 6/2010 | Graf | B41J 2/1753 358/1.15 |
| 8,161,200 | B2 | 4/2012 | Kostadinov | |
| 9,333,781 | B2 | 5/2016 | Qu et al. | |
| 2001/0048451 | A1 * | 12/2001 | Saul | B41J 2/04541 347/9 |
| 2002/0111771 | A1 | 8/2002 | Huang et al. | |
| 2003/0188067 | A1 | 10/2003 | Okin | |
| 2003/0229748 | A1 | 12/2003 | Brewer et al. | |
| 2006/0106514 | A1 | 5/2006 | Liebl et al. | |
| 2008/0244147 | A1 | 10/2008 | Chen | |
| 2010/0100657 | A1 | 4/2010 | Ji et al. | |
| 2011/0276724 | A1 | 11/2011 | Mullis et al. | |
| 2012/0280723 | A1 | 11/2012 | Scott et al. | |
| 2013/0219093 | A1 | 8/2013 | Dipert et al. | |

FOREIGN PATENT DOCUMENTS

| | | | |
|---|---|---|---|
| EP | 1661711 | A1 | 5/2006 |
| EP | 2133209 | A2 | 12/2009 |
| FR | 2915130 | A1 | 10/2008 |
| WO | 2014/059896 | A1 | 4/2014 |

OTHER PUBLICATIONS

"Communication pursuant to Article 94(3) EPC," issued by the European Patent Office on Sep. 25, 2015 in connection with EP Patent Application No. 13710142.4.

Office action issued in connection with Chinese Patent Application No. 20138008772.3 on Mar. 2, 2016.

International Search Report and Written Opinion for Application No. PCT/US2013/027102 dated May 13, 2013.

The United States Patent and Trademark Office, "Office action," issued in connection with U.S. Appl. No. 13/773,161 on Jul. 7, 2016 (24 pages).

The United States Patent and Trademark Office, "Office action," issued in connection with U.S. Appl. No. 13/773,161 on Dec. 2, 2015 (14 pages).

The United States Patent and Trademark Office, "Office action," issued in connection with U.S. Appl. No. 13/773,161 on Apr. 9, 2015 (10 pages).

* cited by examiner

HIGH SPEED ADAPTIVE THERMAL PRINTHEAD INTERFACE

FIELD

Embodiments discussed herein are related to printhead technology and, more particularly, to systems, methods, apparatuses, and other means for providing an adaptive printhead interface.

BACKGROUND

A number of deficiencies and problems associated with thermal printhead technology are identified herein. Through applied effort, ingenuity, and innovation, exemplary solutions for many of these identified problems are embodied by the present invention, which is described in detail below.

BRIEF SUMMARY

Systems, methods, and apparatuses are disclosed for a high-speed adaptive thermal printhead interface. Embodiments of the present invention provide a high-speed adaptive thermal printhead interface (HSATPHI) that incorporates an electrically configurable main board interface and allows for identifying the thermal printhead as having a specific class or bandwidth print data channel including current and future technology thermal printhead interfaces. The high-speed adaptive thermal printhead interface may allow for the introduction of higher data throughput for printing applications and allow for features that require higher speeds of data, while maintaining support for older, slower, and/or less costly interface configurations.

In one embodiment, an apparatus is provided comprising at least one processor; and at least one memory including computer program instructions. The apparatus comprises the computer program instructions being configured to, when executed by the at least one processor, cause the apparatus at least to determine identifier information for a connected printhead; retrieve printhead interface configuration data for a configurable printhead interface based at least in part on the identifier information; configure printhead interface circuitry in accordance with the printhead interface configuration data; and enable communication with the printhead through the configurable printhead interface.

In some embodiments, the apparatus further comprises wherein the printhead comprises a thermal printhead.

In some embodiments, the apparatus further comprises the computer program instructions further configured to, when executed by the at least one processor, cause the apparatus to determine identifier information for a connected printhead at least in part by querying the connected printhead for the identifier information. In some embodiments, the apparatus further comprises wherein the identifier information is stored in a memory of the connected printhead. In some embodiments, the apparatus further comprises wherein the identifier information is queried from the connected printhead using a dedicated signal bus.

In some embodiments, the apparatus further comprises the computer program instructions further configured to, when executed by the at least one processor, cause the apparatus to determine whether the connected printhead is a valid printhead based in part on the identifier information.

In some embodiments, the apparatus further comprises the computer program instructions further configured to, when executed by the processor, cause the apparatus at least to retrieve printhead configuration data from the connected printhead.

In some embodiments, the apparatus further comprises wherein configuring the printhead interface circuitry comprises one or more of: selecting one or more of pre-defined input/output and configurable input/output; selecting the active signal lines for the printhead interface; defining inputs and outputs for the printhead interface; selecting input/output voltage for each signal line; selecting driver/receiver type; selecting synchronization domain or type; selecting switching thresholds; selecting differential paring; selecting pre-emphasis; selecting data rates; and selecting on chip termination.

In some embodiments, the apparatus further comprises wherein the configurable printhead interface is configured to provide for serialization and deserialization of multiple data streams.

In another embodiment, a system is provided comprising a printhead and a configurable printhead interface. The printhead comprising printhead circuitry; and at least one printhead memory. The configurable printhead interface comprising at least one processor; at least one memory including computer program instructions; and configurable printhead interface circuitry. The configurable printhead interface further comprises the computer program instructions being configured to, when executed by the at least one processor, cause the configurable printhead interface at least to query the printhead for identifier information stored in the at least one printhead memory; retrieve printhead interface configuration data based at least in part on the identifier information; configure the configurable printhead interface circuitry in accordance with the printhead interface configuration data; and enable communication with the printhead using the configured configurable printhead interface circuitry. In some embodiments, the system further comprises wherein the printhead comprises a thermal printhead.

In some embodiments, the system further comprises the configurable printhead interface comprising computer program instructions further configured to, when executed by the at least one processor, cause the configurable printhead interface at least to retrieve printhead configuration data from the at least one printhead memory of the printhead.

In some embodiments, the system further comprises the configurable printhead interface comprising computer program instructions further configured to, when executed by at least one processor, cause the configurable printhead interface to determine whether the printhead is a valid printhead based in part on the identifier information.

In some embodiments, the system further comprises wherein configuring the printhead interface circuitry comprises one or more of: selecting one or more of pre-defined input/output and configurable input/output; selecting the active signal lines for the printhead interface; defining inputs and outputs for the printhead interface; selecting input/output voltage for each signal line; selecting driver/receiver type; selecting synchronization domain or type; selecting switching thresholds; selecting differential paring; selecting pre-emphasis; selecting data rates; and selecting on chip termination.

In some embodiments, the system further comprises wherein the identifier information is queried from the printhead and transmitted to the configurable printhead interface using a dedicated signal bus.

In some embodiments, the system further comprises wherein the configurable printhead interface is configured to provide for serialization and deserialization of multiple data streams.

In some embodiments, the system further comprises the printhead further comprising printhead safety circuitry, the printhead safety circuitry configured to, in association with the printhead circuitry, detect a defined safety condition, and cause the printhead to be de-energized as a result of the detected safety condition. In some embodiments, the system further comprises wherein the printhead safety circuitry is further configured to transmit a signal to provide notification of the detected safety condition. In some embodiments, the system further comprises wherein one or more of the printhead circuitry, the printhead safety circuitry, or the configurable printhead interface circuitry configured to perform error correction on received signals enabling recovery from signal errors. In some embodiments, the system further comprises wherein one or more of the printhead circuitry, the printhead safety circuitry, or the configurable printhead interface circuitry further comprises redundant circuitry to provide fault tolerance.

In another embodiment, a method is provided which comprises determining, by a processor, identifier information for a connected printhead; retrieving printhead interface configuration data for a configurable printhead interface based at least in part on the identifier information; configuring, by the processor, printhead interface circuitry in accordance with the printhead interface configuration data; and enabling communication with the printhead through the configurable printhead interface. In some embodiments, the method further comprises wherein the printhead comprises a thermal printhead.

In some embodiments, the method further comprises wherein determining identifier information for a connected printhead comprises querying the connected printhead for the identifier information. In some embodiments, the method further comprises wherein the identifier information is stored in a memory of the connected printhead. In some embodiments, the method further comprises wherein the identifier information is queried from the connected printhead using a dedicated signal bus. In some embodiments, the method further comprises determining whether the connected printhead is a valid printhead based in part on the identifier information.

In some embodiments, the method further comprises retrieving printhead configuration data from the connected printhead. In some embodiments, the method further comprises wherein configuring the printhead interface circuitry comprises one or more of: selecting one or more of pre-defined input/output and configurable input/output; selecting the active signal lines for the printhead interface; defining inputs and outputs for the printhead interface; selecting input/output voltage for each signal line; selecting driver/receiver type; selecting synchronization domain or type; selecting switching thresholds; selecting differential paring; selecting pre-emphasis; selecting data rates; and selecting on chip termination.

In some embodiments, the method further comprises configuring the configurable printhead interface to provide for serialization and deserialization of multiple data streams.

In another embodiment, a computer program product is provided comprising at least one non-transitory computer-readable medium and computer program instructions stored therein, the computer program instructions comprising program instructions configured, when executed, at least to determine identifier information for a connected printhead; retrieve printhead interface configuration data for a configurable printhead interface based at least in part on the identifier information; configure printhead interface circuitry in accordance with the printhead interface configuration data; and enable communication with the printhead through the configurable printhead interface.

In some embodiments, the computer program product further comprises computer program instructions configured, when executed, to query the connected printhead for the identifier information.

In some embodiments, the computer program product further comprises computer program instructions configured, when executed, to determine whether the connected printhead is a valid printhead based in part on the identifier information.

In some embodiments, the computer program product further comprises computer program instructions configured, when executed, to retrieve printhead configuration data from the connected printhead.

In some embodiments, configuring the printhead interface circuitry comprises one or more of: selecting one or more of pre-defined input/output and configurable input/output; selecting the active signal lines for the printhead interface; defining inputs and outputs for the printhead interface; selecting input/output voltage for each signal line; selecting driver/receiver type; selecting synchronization domain or type; selecting switching thresholds; selecting differential paring; selecting pre-emphasis; selecting data rates; and selecting on chip termination.

In some embodiments, the printhead comprises a thermal printhead.

BRIEF DESCRIPTION OF THE SEVERAL VIEWS OF THE DRAWINGS

Figure 1:
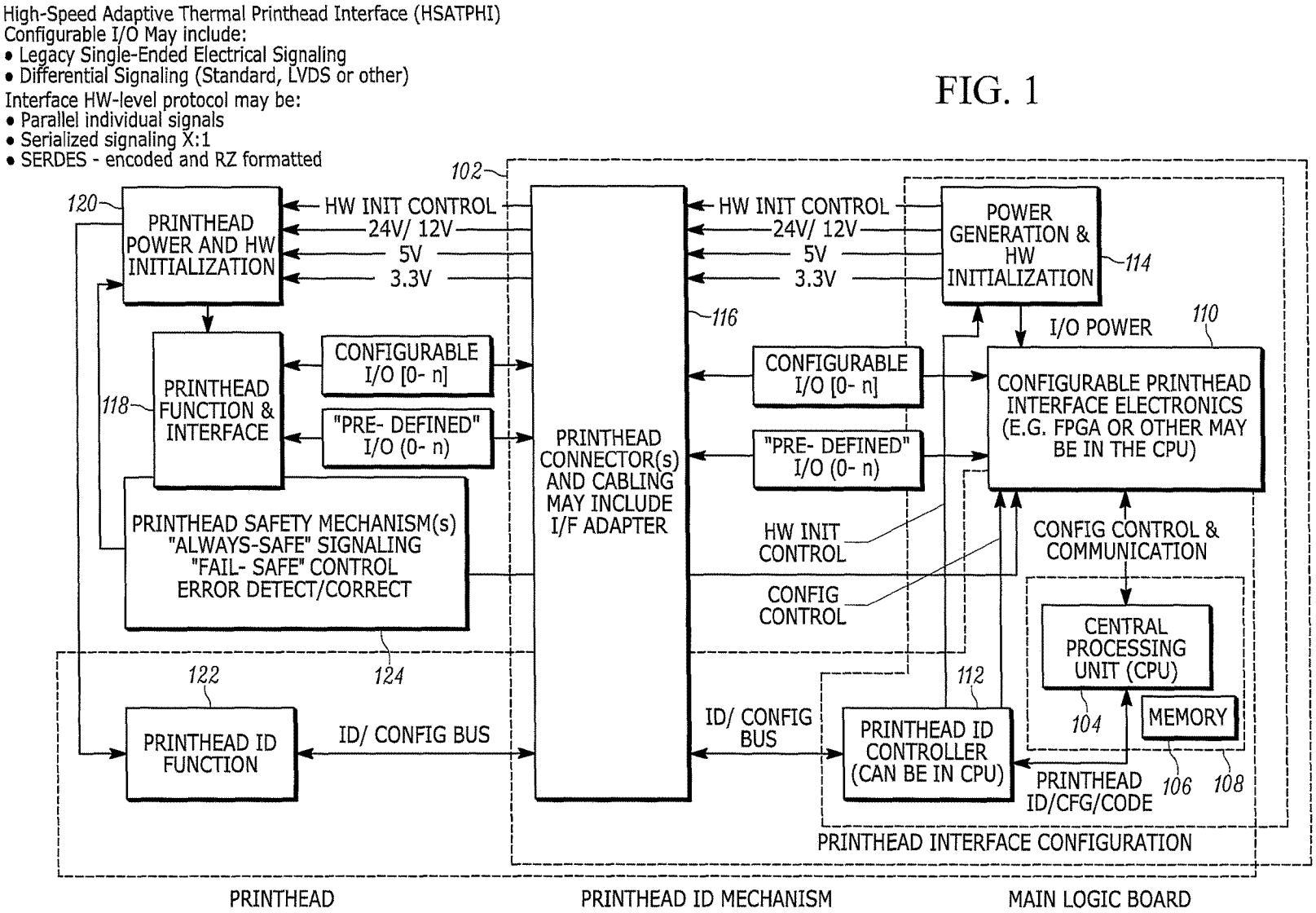
Figure 2:
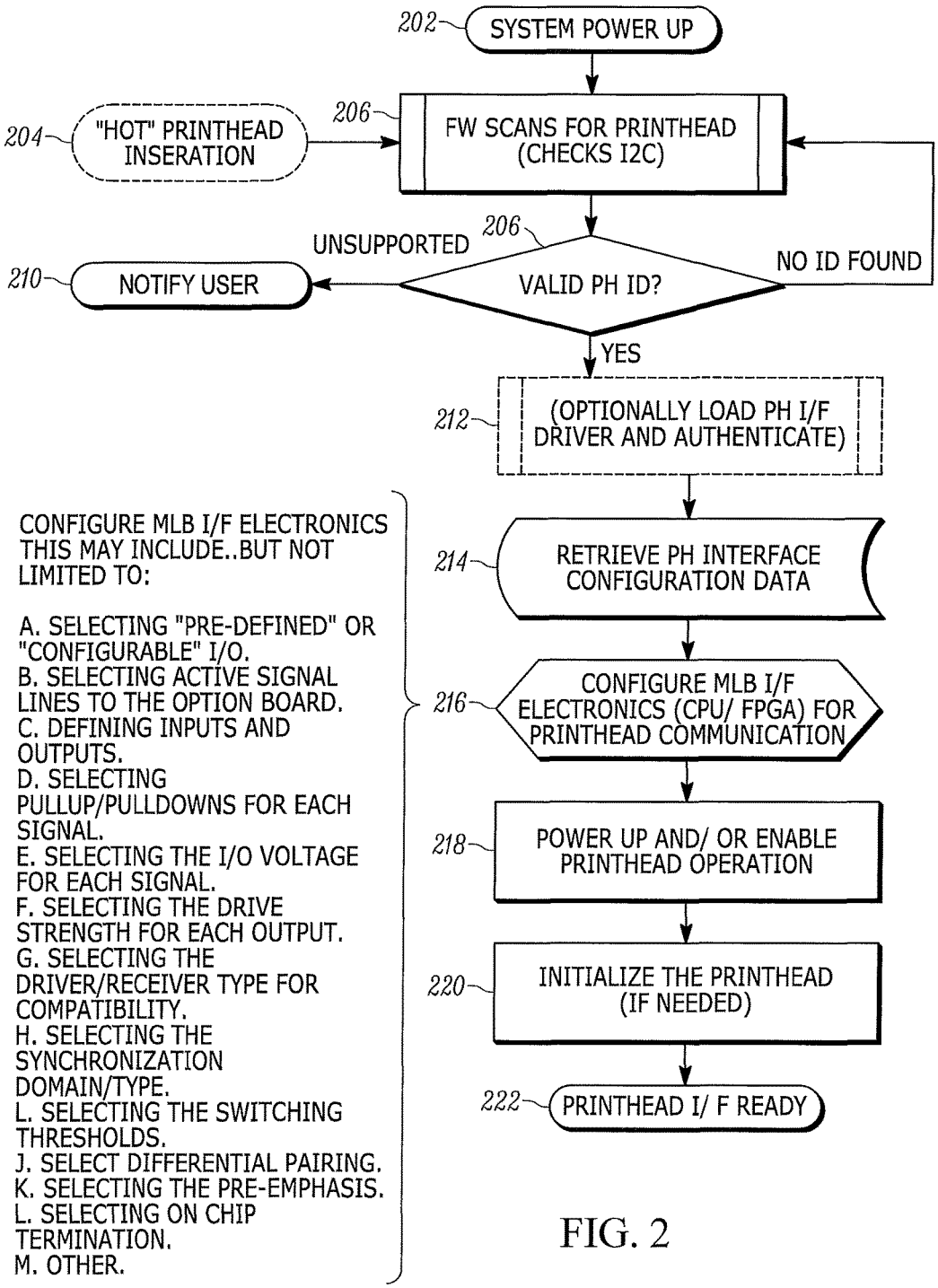
Figure 3A:
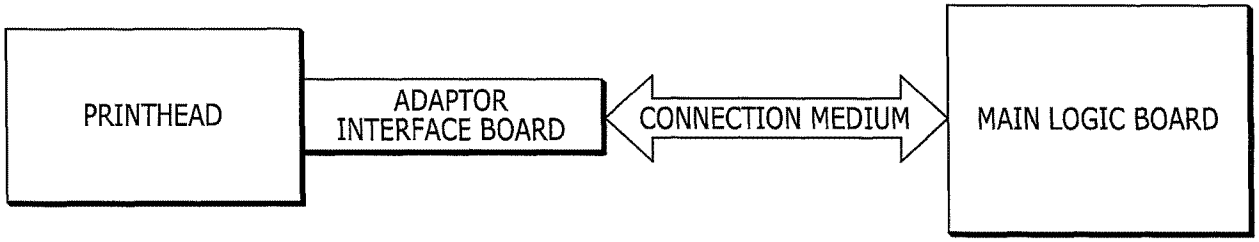
Figure 3B:
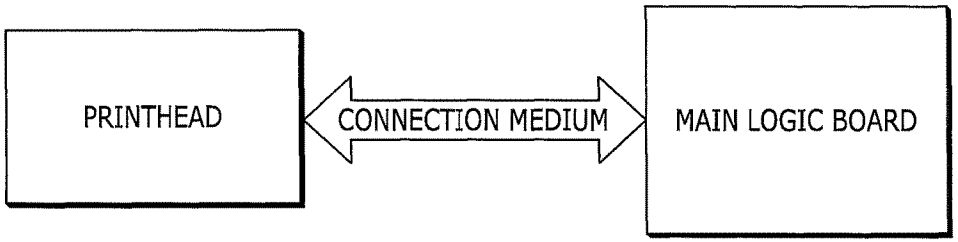

Having thus described the invention in general terms, reference will now be made to the accompanying drawings, which are not necessarily drawn to scale, and wherein:

FIG. 1 provides a block diagram of an exemplary high-speed adaptive thermal printhead interface in accordance with some embodiments of the present invention;

FIG. 2 provides a flowchart of exemplary operations for the identification of a printhead and configuration of the printhead interface in accordance with some embodiments of the present invention; and FIGS. 3A and 3B illustrate block diagrams of generic components in a system with an exemplary high-speed adaptive thermal printhead interface in accordance with some embodiments of the present invention.

DETAILED DESCRIPTION

The present invention now will be described more fully hereinafter with reference to the accompanying drawings, in which some, but not all embodiments of the inventions are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Embodiments of the present invention are directed to a high-speed adaptive printhead interface that incorporates an electrically configurable main board interface. Embodiments provide for identifying the printhead as having a specific class or bandwidth print data channel or other configuration requirements, including current and future technology printhead interfaces. A variety of printheads are used in current printing technologies, including inkjet printheads, piezoelectric printheads, thermal printheads, and the like. Some embodiments of the present invention are directed to thermal printhead technology.

Thermal printhead technology generally has a single-ended electrical signaling topology over a simple ribbon cable structure that has limited performance and data transmission speed due to the electrical limitations of the electrical drivers, connectors, cabling, and printhead electronics. In addition, this current technology signaling suffers from signal degradation and electronic interference. In example embodiments, the high-speed adaptive thermal printhead interface may provide a high bandwidth channel, or the option of several channels of different bandwidths, from the processor to the thermal printhead by use of serialized and/or encoded data transfer protocols. Embodiments of the high-speed adaptive thermal printhead interface enable higher speed printing of black & white barcodes, text, and higher bandwidth functions such as grey scale and color at speeds not currently achievable. Embodiments of the high-speed adaptive thermal printhead interface may allow for features that require higher speeds of data transmission through printing systems.

Thermal printhead technology generally has significant potential for electrical and electro-magnetic interference due to the electrical limitations of the electrical drivers, connectors, cabling, and printhead electronics. In example embodiments, the high-speed adaptive thermal printhead interface may provide low electrical and electro-magnetic interference implementations by using differential interfacing. Differential signaling also improves immunity to external interference.

For example, in some embodiments, the high-speed adaptive thermal printhead interface may allow for differential signaling where no common ground is needed in the interface and providing for two signals that are mirror images. In such embodiments, the electromagnetic fields may cancel and provide for lower emissions and may allow for running at lower voltages.

In some embodiments, the high-speed adaptive thermal printhead interface may allow for serializing the data so that data may be transmitted using higher speed signaling protocols. The high-speed adaptive thermal printhead interface may provide for parallel to serial conversion to be handled in the interface. For example, many signals may need to be transmitted across the interface, so the signals may be serialized down to a certain number of lines on one side and then deserialized on the other side into the necessary number of lines.

Thermal printhead technology generally has no concept of mixing interface types or allowing selection of different interface types for particular applications or product stock keeping units (SKUs). In example embodiments, the high-speed adaptive thermal printhead interface provides a flexible/configurable interface allowing multiple electrical interface technologies to be utilized with the same main processor subsystem electronics. In example embodiments, the high-speed adaptive thermal printhead interface may allow new and old interface types to be accommodated by a printer.

In example embodiments, the high-speed adaptive thermal printhead interface incorporates an electrically configurable main board interface, a print data channel which may be one of several electrical and physical implementations supporting different bandwidth data, thermal printhead electrical interface circuitry, and an identification channel connecting the main board processor to a thermal printhead. In example embodiments, the high-speed adaptive thermal printhead interface may incorporate an identification method physically residing on the thermal printhead and identifying the thermal printhead as having a specific class or bandwidth print data channel or other configuration requirements. In other embodiments, the high-speed adaptive thermal printhead interface may comprise an adaptor board that is positioned between the thermal printhead and the connection medium (e.g., cabling and/or connectors). In such embodiments, the identification method may comprise a memory device on the adaptor board.

The high-speed adaptive thermal printhead interface may allow printheads to be cost-function tailored to the application. For example, the high-speed adaptive thermal printhead interface may provide backward compatibility for existing printheads using single-ended electrical signaling and parallel data transfers may be supported as well as compatibility for new printheads using differential electrical signaling and serialized data transfers with or without data encoding. Older technology printheads may be less costly than new printheads with higher speed interfaces and, thus, may be preferable in some circumstances.

In example embodiments, the main board interface is electrically flexible such that it may be configurable for any expected electrical option, based on the type of printhead that is connected. In example embodiments, the specific thermal printhead interface configuration being used by the thermal printhead may be identified through the identification channel by a main board, such as using a central processor, so that the central processor can configure the main board interface. In example embodiments, the identification channel may be used at power-up to identify the thermal printhead interface type and the central processor configures the main board interface electronics based on the printhead identification. In some embodiments, the identification channel may also be used after "hot-swap" of the thermal printhead to identify the thermal printhead interface type so the central processor can reconfigure the main board interface electronics. Use of this reconfiguration capability reduces system downtime which is desirable for customers using printers in high use applications.

In some embodiments, the high-speed adaptive thermal printhead interface may comprise an adaptor interface board that is positioned between the printhead and the transmission medium, e.g., the cabling, that would otherwise be connected to the printhead, as illustrated in FIG. 3A. The adaptor interface board may be configured to provide printhead identification information for use in configuring the printhead interface. The adaptor interface board may be further configured to provide circuitry and processes such as differential drivers and receivers, serial drivers, and the like, used in conjunction with the high-speed adaptive thermal printhead interface. In other embodiments, circuitry and processes used in conjunction with the high-speed adaptive thermal printhead interface may be comprised within the printhead, as illustrated in FIG. 3B, such as comprising integrated circuits and/or memory devices within the printhead.

Example embodiments of the high-speed adaptive thermal printhead interface may allow for querying the printhead or adaptor interface board to determine what printhead has been connected, and/or what interface functionality is available. Upon determining the printhead, the main board interface electronics are configured as necessary for the particular connected printhead. For example, some embodiments may allow for selecting the output characteristics of field programmable gate arrays (FPGAs) on the main logic board to have single ended output, differential output, etc., depending on the printhead being connected. For example, the high-speed adaptive thermal printhead interface may determine that the printhead uses differential signaling and configure the interface electronics accordingly. At a subsequent time, the printhead may be changed to a different printhead and the high-speed adaptive thermal printhead interface may determine that the connected printhead uses single ended output and reconfigure the main board interface electronics accordingly.

Safety is another concern in current thermal printhead technology. For example, if not properly controlled, a printhead could destroy itself, or burn through other materials within the printing system, or be left in a mode which provides unsafe voltages or temperatures to a person servicing the printer. As such, it may not be desirable to run some signals through a serializer or signaling must be done with extreme care and a certain level of reliability that would not be necessary with other types of devices. In some embodiments, the high-speed adaptive thermal printhead interface may provide for mixed technologies in one interface to address such concerns.

For example, in serialization/deserialization, multiple data streams (or lines) are combined into a single line and at the other end the single line may be separated into the appropriate number of lines. If a single serial link breaks, this might cause issues such as the printhead doing unintended things. In some example embodiments, along with the serializer/deserializer communication channels, an additional single ended channel may be configured that does not depend on the serializer/deserializer communication channels. Thus, if a serial channel link breaks, the additional signal may still be provided to control the printhead.

In some embodiments, the high-speed adaptive thermal printhead interface may be configured to operate safely in communication failure situations, such as a communication line break, etc. The intent being to ensure that critical safety signals are always able to control the printhead. This would apply to certain types of printhead control signals, such as printhead on, elements on, and the like. For example, in the presence of large amounts of signal noise, the serializer/deserializer may no longer function effectively. As such, the high-speed adaptive thermal printhead interface may be configured to provide a non-serialized, differential I/O port for a signal that would always be received correctly by the printhead. In this case, if the serializer/deserializer link fails to function correctly, the critical safety signals are still able to operate and control the potentially hazardous functions of the printhead.

In some embodiments, the high-speed adaptive thermal printhead interface may additionally or alternatively be configured with "fail safe" functions on the printhead side of the interface to recover from certain situations, such as a communication line break, etc. This would ensure that critical safety signals force the head into a safe state when a failure occurs for certain types of printhead control signals, such as printhead on, elements on, and the like. For example, in the presence of large amounts of signal noise, the serializer/deserializer may no longer function effectively. As such, the high-speed adaptive thermal printhead interface may be configured such that when a failure occurs, the "fail-safe" circuitry will force the printhead into a safe or disabled mode. An example of this would be a pull-down resistor which connects the printhead serialized signal on the printhead to ground. If the signal line is cut the printhead is forced into the disabled state.

In some embodiments, the high-speed adaptive thermal printhead interface may be configured to ensure that signals that come out of deserialization may be identified as bad or are always good for certain types of printhead control signals, such as printhead on, elements on, and the like. For example, in the presence of large amounts of signal noise, the serializer/deserializer may no longer function effectively, resulting in errors in the high speed serialized transmission. As such, the high-speed adaptive thermal printhead interface may be configured to provide error detection or degradation in the reliability of the channel, and then "fail safe" circuitry would force the critical signals to a safe state on the printhead. Error detection may take many forms, with one preferred form being added symbol bits in the serialized bit stream which form a cyclic redundancy check (CRC) generated by the circuitry on the main board that can be validated by the printhead (or adaptor interface board) circuitry. Further, the printhead circuitry may correct the error in the transmitted bit stream if sufficient additional symbol bits are provided. In this case, the deserialized signals are always good except in extreme cases of degradation.

In some embodiments, the high-speed adaptive thermal printhead interface may be configured with additional circuitry, programming, or the like to ensure safe operation of the printer in the presence of a large set of possible failures. For example, embodiments of the high-speed adaptive thermal printhead interface may be configured with CRC or other error correction mechanisms to provide recovery from errors. In another example, embodiments of the high-speed adaptive thermal printhead interface may be configured with fully redundant circuitry with seamless fault tolerance. Such embodiments may ensure that there is no loss of operation or impact to printer safety by the inclusion of such added circuitry or functions that are fault tolerant or fault resistant.

In some embodiments, the high-speed adaptive thermal printhead interface may provide for the dynamic configuration of the printhead interface depending on the specifics of the connected printhead, for example using single ended signaling for low dpi printheads and using other configurations for higher dpi printheads to allow for higher speeds. For example, in some embodiments, the configuration for a printhead may not use all the available channels, e.g., 10 channels may be available through the printhead interface, and one type of printhead may only use five of the channels, whereas when another printhead is connected it may use all ten of the channels. In another example embodiment, signals may be swapped within the defined signals to printhead to optimize for specific printhead routing or similar reasons. For example, for one printhead a control line may be on pin 1 and a data line may be on pin 3, while for another printhead the clock line may be better on pin 3 with the data line on pin 1.

In an example embodiment, the main logic board may query the external device, either the printhead or the adaptor interface board, such as by using an I2C (Inter-Integrated Circuit) port connected to a memory device on the printhead or the adaptor interface board, to determine identification data for the printhead. The main logic board may read the identification, determine the type of printhead, and determine the appropriate configuration for the printhead interface, such as the appropriate type of signaling, the number of channels, the speed of the printhead, the data rate, etc., and configure the printhead interface accordingly.

In some embodiments, the high-speed adaptive thermal printhead interface may be further configured to allow for field configuration changes of the printhead. For example, in some embodiments, field changes may require that the system be powered down before the printhead is changed, and then upon powering up, the printhead interface would be reconfigured based on the new printhead. Alternatively or additionally, the high-speed adaptive thermal printhead interface may be configured to power down (i.e., de-energize) the printhead to allow for changing the printhead without necessarily powering down the entire system. In such case, after the new printhead has been connected, the interface is then reconfigured based on the new printhead and the new printhead would be energized.

In some embodiments, the high-speed adaptive thermal printhead interface may be further configured to allow for on-the-fly configuration changes not necessarily associated with the change of a printhead. For example, the high-speed adaptive thermal printhead interface may be further configured to allow for configuration changes to the printhead interface based on an application or job, such as changing resolution, changing the number of strobes to preserve battery life in mobile configurations, etc.

Example High-Speed Adaptive Thermal Printhead Interface

FIG. 1 provides a block diagram of an exemplary high-speed adaptive thermal printhead interface in a printing system in accordance with some embodiments of the present invention. FIG. 1 illustrates a configurable printhead interface 102 with a main logic board, printhead interface circuitry, and printhead connectors and/or cabling, as well as a connected printhead.

The main logic board may at least comprise a processor such as central processing unit (CPU) 104, at least one memory such as memory 106, configurable printhead interface circuitry 110, printhead identification control circuitry 112, and power generation and hardware initialization circuitry 114. The processor and memory, such as CPU 104 and memory 106, may be dedicated to the configurable printhead interface 102 or may be shared with other functions in a system. In example embodiments, the CPU 104 and the memory 106 of the main logic board may comprise the configuration control circuitry 108 which controls operations to identify a printhead and configure the configurable printhead interface circuitry. For example, program code instructions, printhead identifier reference tables, configuration data, and the like may be stored by memory 106 and may be accessed and/or executed by CPU 104 in performing operations to identify a printhead and configure the printhead interface.

The configurable printhead interface circuitry 110 may comprise circuitry such as one or more field programmable gate arrays (FPGAs) or other discrete hardware circuits. In some embodiments, the configurable printhead interface circuitry 110 may be comprised within a processor, e.g., CPU 104. In some embodiments, the configurable printhead interface circuitry 110 may comprise one or more FPGAs together with a configuration method to support field configuration of the FPGAs through software or the like. The method may comprise instructions stored in a memory device, e.g. stored in memory 106, that may comprise a new device driver to configure the configurable printhead interface electronic circuitry and a protocol to communicate with the printhead according to its standard requirements. The configurable printhead interface circuitry 110 may further be further configured to control configurable input/output (I/O) signal lines that may be used for the transmission of data to/from the printhead and the configurable printhead interface circuitry 110 may also control pre-defined I/O signal lines for transmission of data between the main logic board and the printhead.

The printhead identification control circuitry 112 may be configured to receive data from the printhead, or the adaptor interface board, that may be used to identify the printhead and allow for configuration of the printhead interface circuitry. In some embodiments, the printhead identification control circuitry 112 may be comprised within the processor, e.g., CPU 104.

The power generation and hardware initialization circuitry 114 may provide hardware initialization control and power for the printhead interface and/or printhead as necessary. In some embodiments, the power generation and hardware initialization circuitry 114 may be further configured to control "hot-swapping" of a printhead, e.g., by controlling configuration of power for a printhead, such as through a hardware initialization control (HW Init Control) signal line. For example, the power generation and hardware initialization circuitry 114 may provide for transmitting signals to power down the printhead to allow for the printhead to be swapped without necessarily powering down the entire system. While FIG. 1 illustrates providing certain voltages between the power generation and hardware initialization circuitry 114 of the main logic board and the printhead power and hardware initialization circuitry 120 of the printhead, these voltages are not intended to be exclusive, but merely exemplary.

The configurable printhead interface 102 may further comprise a printhead connection interface 116 which provides the connection interface between the main logic board and configurable printer interface circuitry and the printhead. The printhead connection interface 116 may have fixed and/or configurable elements. In some embodiments, the printhead connection interface 116 may, alternatively, be located at the printhead.

The printhead may comprise printhead function and interface circuitry 118, printhead power and hardware initialization circuitry 120, and optionally, printhead safety mechanisms/circuitry 124. Hardware initialization control signals as well as power may be transmitted from the power generation and hardware initialization circuitry 114 (of the main logic board) through the printhead connection interface 116 to the printhead power and hardware initialization circuitry 120. The printhead connection interface 116 may provide the configurable printhead specific input/output, as well as pre-defined input/output, from the configurable printhead interface circuitry 110 to the printhead function and interface circuitry 118.

Printhead identification circuitry 122 may be comprised within the printhead or the adaptor interface board and may be configured to provide data to the main logic board for use in identifying the connected printhead, and the associated configuration requirements. For example, printhead identification control circuitry 112 may be used by the configuration control circuitry 108 to query the printhead identification circuitry 122 using a dedicated signal bus (e.g., an I2C bus) between the main logic board and the printhead identification circuitry 122. The printhead identification circuitry 122 may then return data to the printhead identification control circuitry 112 which may be used, such as by the configuration control circuitry 108, to identify the printhead and determine the appropriate configuration of the configurable printhead interface circuitry.

Optional printhead safety mechanisms/circuitry 124 may provide functionality to ensure the safety of the printhead, e.g., to prevent harm to persons, damage to property, and/or damage to the equipment. In an example embodiment, the printhead safety mechanisms/circuitry 124 may provide a signal path to the printhead power block, e.g., printhead power and hardware initialization circuitry 120, to shut down the power for the printhead, e.g., de-energize the printhead, for safety reasons. The printhead safety mechanisms/circuitry 124 may also provide a signal back to the main logic board to provide notification of a hazardous condition and/or safety operation at the printhead. For example, the main logic board, such as using configurable printhead interface circuitry 110, CPU 104, and/or the like, may receive signals from the printhead safety mechanisms/circuitry 124 and then provide notifications to a printer user of the condition, for example, through a printer's user interface. The printhead safety mechanisms/circuitry 124 may operate automatically and autonomously from other printhead circuitry to ensure the safety of printhead operations.

Optionally, other safety mechanisms may be provided for and/or other safety operations may be performed by a system processor. For example, the system may provide notifications to a user to inform of various conditions, the main processor may perform safety functions such as shutting down printhead power supplies as a secondary response, and the like. As such, in some embodiments safety response functions may be handled automatically by the printhead and/or printhead with a system processor also controlling other safety response functions. In some embodiments, functions may be provided for a user to configure a desired safety response for particular conditions instead of using a default configuration. For instance, in an application where system up-time is more valuable than label accuracy or system components, safety responses can be configured to provide notifications rather than shutting down the system or de-energizing the printhead.

Embodiments may provide safety features that are more robust than a more cost-effective technology used for the high-speed data transmission to a printhead. Embodiments may provide safety features that "fail-safe" automatically and immediately, for example fail-safe to off or disabled states. Embodiments may provide safety features that provide redundant operations, for example error correcting or fully redundant links.

Exemplary Printhead Identification and Interface Configuration

FIG. 2 provides a flowchart of exemplary operations for the identification of a printhead and configuration of the configurable printhead interface, e.g. configurable printhead interface 102 of FIG. 1, in accordance with some embodiments of the present invention. The operations illustrated in FIG. 2 may be performed as part of system or firmware process to configure the printhead interface electronics for use with a particular connected printhead.

In some embodiments, the main logic board software/firmware, e.g., configuration control circuitry 108, may perform a printhead discovery sequence to determine the printhead ID on a dedicated identification/configuration bus (ID/Config Bus), as illustrated in FIG. 1, and then utilize the printhead ID information in determining configuration requirements to electrically configure the configurable printhead interface circuitry, e.g., configurable printhead interface circuitry 110. The configuration control circuitry may perform a table lookup of the printhead ID to establish the proper printhead interface configuration (e.g., number of signal lines, type of signaling, speed of printhead, etc.) or configuration control circuitry may control the transfer of the configuration information from the printhead or adaptor interface board over the ID/Config Bus. In the latter case, configuration information may be stored initially on the printhead or adaptor interface board and accessed by the main logic board.

Operation may begin at block 202 when the printhead is connected to the system and the system is powered up. Alternatively in some embodiments, operations may begin at block 204 where a field change of the printhead has been made. At block 206 the configuration control circuitry may query the printhead or adaptor interface board for data to identify the connected printhead, which may be stored in a memory device on the printhead or adaptor interface board. For example, in some embodiments, the configuration control circuitry 108 or the printhead identification control circuitry 112 may query the printhead identification circuitry 122, such as over a dedicated I2C bus, for the printhead identification data. In some embodiments, the printhead identification data may be stored on a memory device that is also used to provide encryption on the printhead and used in determining that the printhead is valid for the printing system. In some embodiments, the printhead identification data may, alternatively, be queried using NFC (near field communication), RFID (radio frequency identification), or even by using mechanical keying in place of an ID/Config bus. In mechanical keying, there would be a sensing device which determines the keying type based on a uniquely shaped mechanical key on the printhead. In some embodiments, mechanical keying may also provide for some of the selection of the interface signal type usage for the printhead.

At block 208, a determination is made of whether a valid printhead ID has been found, such as by the configuration control circuitry 108 or the printhead identification control circuitry 112. If no printhead ID has been found, operation may return to block 206. If the found printhead ID is not supported by the printing system, operation may continue to block 210 where a notification may be provided that the printhead is not supported.

If a valid and supported printhead is identified, operations may optionally proceed to block 212 in some embodiments, or operations may proceed to block 214. At block 212, if a printhead interface driver is stored at the printhead or adaptor interface board, the printhead interface driver may be retrieved, for example, over the ID/Config bus, and authenticated, such as by the configuration control circuitry 108 or the configurable printhead interface circuitry 110.

At block 214, the printhead ID is used to retrieve printhead interface configuration data for the identified printhead, such as by configuration control circuitry 108. At block 216, the retrieved printhead interface configuration data is used to configure the configurable printhead interface circuitry to provide the appropriate printhead interface for communications with the connected printhead. In some example embodiments, the configuration of the configurable printhead interface circuitry may include, but is not limited to: selecting pre-defined, configurable I/O, fail safe channel, etc. for the printhead; selecting active signal lines (e.g., a particular printhead configuration may not use all available signal lines for I/O); defining inputs and outputs for the configured printhead interface; selecting pullups and pulldowns for each signal line; selecting an input/output voltage for each signal line; selecting a drive strength for each output; selecting the driver/receiver type for compatibility through the interface; selecting a synchronization domain/type; selecting switching thresholds; selecting differential pairing; selecting the pre-emphasis; selecting on chip termination; selecting clock speed of the printhead; selecting data rates; and the like. In some embodiments, these configuration choices may be made in the processor, e.g., CPU 104, configuration control circuitry 108, and implemented by command control signals to the configurable printhead interface circuitry. In some embodiments, configuration of the configurable printhead interface circuitry may comprise the setting of switches, configuration in another integrated circuit, configuration of a FPGA, or the like.

Once the configurable printhead interface circuitry has been configured, operation may proceed to block 218 where printhead operation is powered up or enabled. At block 220, the printhead may be initialized, if necessary. At block 222, the printhead interface is ready to provide the appropriate functionality and the configuration operation is completed.

In order to provide the operations on the main logic board, the main logic board comprises at least a processor and a non-transitory computer readable storage medium for storage of computer coded instructions that implement the method of identifying the printhead and configuring the configurable printhead interface. Various embodiments described herein are described in the general context of method steps or processes, which may be implemented in one embodiment by a computer program product, embodied in a non-transitory computer-readable storage medium, including computer-executable instructions, such as program code, executed by computers in networked environments. A non-transitory computer-readable medium may include removable and non-removable storage devices including, but not limited to, Read Only Memory (ROM), Random Access Memory (RAM), compact discs (CDs), digital versatile discs (DVD), etc. Generally, program modules may include routines, programs, objects, components, data structures, etc. that perform particular tasks or implement particular abstract data types. Computer-executable instructions, associated data structures, and program modules represent examples of program code for executing steps of the methods disclosed herein. The particular sequence of such executable instructions or associated data structures represents examples of corresponding acts for implementing the functions described in such steps or processes.

In some embodiments, certain ones of the operations above may be modified or further amplified as. Moreover, in some embodiments additional optional operations may also be included. It should be appreciated that each of the modifications, optional additions, or amplifications may be included with the operations above either alone or in combination with any others among the features described herein.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed:

1. An apparatus comprising:

at least one processor; and at least one memory including computer program instructions, the computer program instructions being configured to, when executed by the at least one processor, cause the apparatus at least to:

determine identifier information for a connected printhead;

retrieve printhead interface configuration data for a configurable printhead interface based at least in part on the identifier information;

configure printhead interface circuitry for differential electrical signaling when the printhead interface configuration data corresponds to a first type of printhead;

configure the printhead interface circuitry for single-ended electrical signaling when the printhead interface configuration data corresponds to a second type of printhead; and enable communication with the printhead through the configurable printhead interface.

2. The apparatus of claim 1 wherein the connected printhead comprises a thermal printhead.

3. The apparatus of claim 1, wherein the computer program instructions are further configured to, when executed by the at least one processor, cause the apparatus to determine the identifier information for the connected printhead at least in part by querying the connected printhead for the identifier information.

4. The apparatus of claim 3, wherein the identifier information is stored in a memory of the connected printhead.

5. The apparatus of claim 3, wherein the identifier information is queried from the connected printhead using a dedicated signal bus.

6. The apparatus of claim 1, wherein the computer program instructions are further configured to, when executed by the at least one processor, cause the apparatus to determine whether the connected printhead is a valid printhead based in part on the identifier information.

7. The apparatus of claim 1, wherein the computer program instructions are further configured to, when executed by the at least one processor, cause the apparatus at least to retrieve printhead configuration data from the connected printhead.

8. The apparatus of claim 1, wherein configuring the printhead interface circuitry comprises one or more of:

selecting one or more of pre-defined input/output and configurable input/output;

selecting the active signal lines for the printhead interface;

defining inputs and outputs for the printhead interface;

selecting input/output voltage for each signal line;

selecting driver/receiver type;

selecting synchronization domain or type;

selecting switching thresholds;

selecting differential paring;

selecting pre-emphasis;

selecting data rates; and selecting on chip termination.

9. The apparatus of claim 1, wherein the configurable printhead interface is configured to provide for serialization and deserialization of multiple data streams.

10. A system comprising:
a printhead comprising:
printhead circuitry; and
at least one printhead memory;
a configurable printhead interface comprising:
at least one processor;
at least one memory including computer program instructions; and
configurable printhead interface circuitry;
the computer program instructions being configured to, when executed by the at least one processor, cause the configurable printhead interface at least to:
query the printhead for identifier information stored in the at least one printhead memory;
retrieve printhead interface configuration data based at least in part on the identifier information;
configure the configurable printhead interface circuitry for differential electrical signaling when the printhead interface configuration data corresponds to a first type of printhead;
configure the configurable printhead interface circuitry for single-ended electrical signaling when the printhead interface configuration data corresponds to a second type of printhead; and
enable communication with the printhead using the configured configurable printhead interface circuitry.

11. The system of claim 10 wherein the printhead comprises a thermal printhead.

12. The system of claim 10, wherein the computer program instructions are further configured to, when executed by the at least one processor, cause the configurable printhead interface at least to retrieve printhead configuration data from the at least one printhead memory of the printhead.

13. The system of claim 10, wherein the computer program instructions are further configured to, when executed by at least one processor, cause the configurable printhead interface to determine whether the printhead is a valid printhead based in part on the identifier information.

14. The system of claim 10, wherein configuring the printhead interface circuitry comprises one or more of:
selecting one or more of pre-defined input/output and configurable input/output;
selecting the active signal lines for the printhead interface;
defining inputs and outputs for the printhead interface;
selecting input/output voltage for each signal line;
selecting driver/receiver type;
selecting synchronization domain or type;
selecting switching thresholds;
selecting differential paring;
selecting pre-emphasis;
selecting data rates; and
selecting on chip termination.

15. The system of claim 10, wherein the identifier information is queried from the printhead and transmitted to the configurable printhead interface using a dedicated signal bus.

16. The system of claim 10, wherein the configurable printhead interface is configured to provide for serialization and deserialization of multiple data streams.

17. The system of claim 10, wherein the printhead further comprises printhead safety circuitry, the printhead safety circuitry configured to, in association with the printhead circuitry, detect a defined safety condition, and cause the printhead to be de-energized as a result of the detected safety condition.

18. The system of claim 17, wherein the printhead safety circuitry is further configured to transmit a signal to provide notification of the detected safety condition.

19. The system of claim 17, wherein one or more of the printhead circuitry, the printhead safety circuitry, or the configurable printhead interface circuitry is configured to perform error correction on received signals enabling recovery from signal errors.

20. The system of claim 17, wherein one or more of the printhead circuitry, the printhead safety circuitry, or the configurable printhead interface circuitry further comprises redundant circuitry to provide fault tolerance.

21. A method comprising:
determining, by a processor, identifier information for a connected printhead;
retrieving printhead interface configuration data for a configurable printhead interface based at least in part on the identifier information;
configuring, by the processor, printhead interface circuitry for differential electrical signaling when the printhead interface configuration data corresponds to a first type of printhead;
configuring, by the processor, the printhead interface circuitry for single-ended electrical signaling when the printhead interface configuration data corresponds to a second type of printhead; and
enabling communication with the connected printhead through the configurable printhead interface.

22. The method of claim 21 wherein the printhead comprises a thermal printhead.

23. The method of claim 21, wherein determining identifier information for the connected printhead comprises querying the connected printhead for the identifier information.

24. The method of claim 23, wherein the identifier information is stored in a memory of the connected printhead.

25. The method of claim 23, wherein the identifier information is queried from the connected printhead using a dedicated signal bus.

26. The method of claim 21 further comprising determining whether the connected printhead is a valid printhead based in part on the identifier information.

27. The method of claim 21, further comprising retrieving printhead configuration data from the connected printhead.

28. The method of claim 21, wherein configuring the printhead interface circuitry comprises one or more of:
selecting one or more of pre-defined input/output and configurable input/output;
selecting the active signal lines for the printhead interface;
defining inputs and outputs for the printhead interface;
selecting input/output voltage for each signal line;
selecting driver/receiver type;
selecting synchronization domain or type;
selecting switching thresholds;
selecting differential paring;
selecting pre-emphasis;
selecting data rates; and
selecting on chip termination.

29. The method of claim 21 further comprising configuring the configurable printhead interface to provide for serialization and deserialization of multiple data streams.

30. The computer program product of claim 21, wherein the printhead comprises a thermal printhead.

31. A computer program product comprising at least one non-transitory computer-readable medium and computer program instructions stored therein, the computer program instructions comprising program instructions configured, when executed, at least to:

determine identifier information for a connected printhead;

retrieve printhead interface configuration data for a configurable printhead interface based at least in part on the identifier information;

configure printhead interface circuitry for differential electrical signaling when the printhead interface configuration data corresponds to a first type of printhead;

configure the printhead interface circuitry for single-ended electrical signaling when the printhead interface configuration data corresponds to a second type of printhead; and enable communication with the printhead through the configurable printhead interface.

32. The computer program product of claim 31, wherein the computer program instructions further comprise program instruction configured, when executed, to query the connected printhead for the identifier information.

33. The computer program product of claim 31, wherein the computer program instructions further comprise program instruction configured, when executed, to determine whether the connected printhead is a valid printhead based in part on the identifier information.

34. The computer program product of claim 31, wherein the computer program instructions further comprise program instruction configured to, when executed, retrieve printhead configuration data from the connected printhead.

35. The computer program product of claim 31, wherein configuring the printhead interface circuitry comprises one or more of:

selecting one or more of pre-defined input/output and configurable input/output;

selecting the active signal lines for the printhead interface;

defining inputs and outputs for the printhead interface;

selecting input/output voltage for each signal line;

selecting driver/receiver type;

selecting synchronization domain or type;

selecting switching thresholds;

selecting differential paring;

selecting pre-emphasis;

selecting data rates; and selecting on chip termination.

* * * * *